US007112046B2

(12) United States Patent
Kammhoff et al.

(10) Patent No.: US 7,112,046 B2
(45) Date of Patent: Sep. 26, 2006

(54) SCROLL COMPRESSOR FOR REFRIGERANT

(75) Inventors: Karl-Friedrich Kammhoff, Weil der Stadt (DE); Thomas Varga, Aidlingen (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 11/104,273

(22) Filed: Apr. 11, 2005

(65) Prior Publication Data

US 2005/0232800 A1 Oct. 20, 2005

Related U.S. Application Data

(63) Continuation of application No. PCT/EP03/09214, filed on Aug. 20, 2003.

(30) Foreign Application Priority Data

Oct. 15, 2002 (DE) ..... 102 48 926

(51) Int. Cl.
*F04C 18/02* (2006.01)

(52) U.S. Cl. ..... 418/55.1; 418/55.4; 418/55.6; 418/270; 418/DIG. 1; 184/6.18

(58) Field of Classification Search ..... 418/55.1–55.6, 418/270, DIG. 1; 184/6.18
See application file for complete search history.

(56) References Cited

U.S. PATENT DOCUMENTS 4,564,339 A 1/1986 Nakamura et al.
4,575,320 A 3/1986 Kobayashi et al.

(Continued)

FOREIGN PATENT DOCUMENTS

| | | | |
|---|---|---|---|
| DE | 198 45 993 | | 4/2000 |
| EP | 0 798 465 | | 10/1997 |
| JP | 05157066 A | * | 6/1993 |
| WO | 02/052205 | | 4/2002 |

OTHER PUBLICATIONS

*Patent Abstracts of Japan*, Abstract of Japanese Patent "Valve Device", Publication No. 05157067, Jun. 22, 1993.

(Continued)

*Primary Examiner*—Theresa Trieu
(74) *Attorney, Agent, or Firm*—Lipsitz & McAllister, LLC

(57) ABSTRACT

The invention relates to a compressor for refrigerant, comprising: an outer housing; a scroll compressor which is disposed in the outer housing; an outlet, which is located in the base of the stationary compressor body and which leads to a high pressure chamber in the outer housing, and; a check valve, which has a valve body and which is disposed between the outlet and the high pressure chamber. The aim of the invention is to improve a compressor of the type described at the beginning in such a way as to ensure that the function of the check valve is as optimal as possible. To this end, the invention provides that the outlet having a center axis which is offset with respect to a center axis of the valve seat for the valve body in a transverse direction in relation to the center axis.

26 Claims, 8 Drawing Sheets

U.S. PATENT DOCUMENTS

| | | | | |
|---|---|---|---|---|
| 5,622,487 | A | 4/1997 | Fukuhara et al. | |
| 6,179,589 | B1 | 1/2001 | Bass et al. | |
| 6,227,830 | B1 | 5/2001 | Fields et al. | |
| 6,364,645 | B1 | 4/2002 | Dieterich | |
| 6,537,043 | B1 * | 3/2003 | Chen | 418/55.1 |
| 6,679,683 | B1 * | 1/2004 | Seibel et al. | 418/55.4 |
| 6,814,551 | B1 * | 11/2004 | Kammhoff et al. | 418/55.1 |
| 6,960,070 | B1 * | 11/2005 | Kammhoff et al. | 418/55.6 |
| 2003/0031570 | A1 | 2/2003 | Kammhoff et al. | |

OTHER PUBLICATIONS

*Patent Abstracts of Japan*, Abstract of Japanese Patent "Sealed Type Compressor", Publication No. 05113186, May 7, 1993.

*Patent Abstracts of Japan*, Abstract of Japanese Patent "Scroll Compressor", Publication No. 10274178, Oct. 13, 1998.

*Patent Abstracts of Japan*, Abstract of Japanese Patent "Scroll Compressor", Publication No. 2000345978, Dec. 12, 2000.

* cited by examiner 42
212
46
36
22
20
210
44
214
40
16
34
12
18
78
76
64
62
72
50
184
4
182
200
14
54
188
102
106
108
104
162
3
192
206
194
160
96
98
112
114
28
32
26
30
24
80
74
82
66
84
56
10
68
70
86
88
90
156
154
152
150
52
100
164
94
92
120
116
118
110

124
36
126
32
22
210
212
44
40
20
16
34
26
18
24
72
62
50
64
132
74
134
66
136
130
128
68
142
140
102
10
100
86
90
88
54
104
52
96
122
178
92
98
116
120
114
110
118
46

SCROLL COMPRESSOR FOR REFRIGERANT

This application is a continuation of international application number PCT/EP2003/009214 filed on Aug. 20, 2003.

The present disclosure relates to the subject matter disclosed in international application number PCT/EP2003/009214 of Aug. 20, 2003 and German application number 102 48 926.2 of Oct. 15, 2002, which are incorporated herein by reference in their entirety and for all purposes.

BACKGROUND OF THE INVENTION

The invention relates to a compressor for refrigerant, comprising an outer housing, a scroll compressor which is disposed in the outer housing and has a first compressor body, which is fixedly disposed in the outer housing, and a second compressor body, which is movable in relation to the first compressor body, each of these bodies having a base and respective first and second scroll ribs, which rise above the respective base and engage in one another in such a way that, for the compression of the refrigerant, the second compressor body is movable on an orbital path about a center axis with respect to the first compressor body, thereby forming chambers, comprising an outlet in the base of the stationary compressor body, leading to a high-pressure chamber in the outer housing, and comprising a check valve disposed between the outlet and the high-pressure chamber, with a valve body which is freely movable in a movement space extending between a valve seat and a valve guard, between a closed position, determined by the valve seat, and an open position, determined by the valve guard.

Such a compressor with a check valve is known from U.S. Pat. No. 5,451,148.

In the case of such a check valve there is generally the requirement that it opens quickly, closes quickly and, when opening, provides as quickly as possible as large a cross-sectional area as possible for a flow to pass through.

It is therefore an object of the invention to improve a compressor of the type, described at the beginning in such a way as to ensure that the function of the check valve is as optimal as possible.

SUMMARY OF THE INVENTION

This object is achieved according to the invention in the case of a compressor of the type described at the beginning by the outlet having a center axis which is offset with respect to a center axis of the valve seat for the valve body in a transverse direction in relation to the center axis. This solution has the advantage that the offset arrangement of the outlet with respect to the valve seat makes the valve undergo an asymmetric force from the inflowing refrigerant when it opens, and consequently makes it open quickly.

The quick opening of the valve body can be achieved particularly advantageously if a cross-sectional area of a through-opening of the valve seat is greater than a cross-sectional area of the outlet, so that a relatively great force can be produced on the valve body by the refrigerant impinging on the valve body.

To be able to make the through-opening have a cross-sectional area which is greater than the cross-sectional area of the outlet, it is preferably provided that a pre-chamber having a greater cross-sectional area than the outlet is disposed between the valve seat and the outlet.

This pre-chamber suitably has a cross-sectional area which either corresponds to the cross-sectional area of the through-opening, which for its part is intended to be greater than the cross-sectional area of the outlet, or is greater than the cross-sectional area of the through-opening of the valve seat.

With regard to the arrangement of the pre-chamber in relation to the outlet, it is suitably provided that a center axis of the pre-chamber is disposed in such a way that it is offset transversely in relation to the center axis of the outlet.

It is particularly advantageous if the center axis of the pre-chamber substantially coincides with the center axis of the valve seat, and consequently the two are disposed substantially coaxially in relation to each other.

For receiving and guiding the valve body, the movement space between the valve seat and the valve guard is preferably provided.

To be able to use a valve body with the smallest possible mass with the greatest possible through-opening through the valve seat, it is preferably provided that the movement space extends in the direction of its center axis from the valve seat to the valve guard with a cross-sectional area which corresponds approximately to the valve seat, that is to say in particular an outside diameter of the same.

Furthermore, an advantageous force effect is obtained on the valve body when the check valve is opened and held open if the center axis of the movement space substantially coincides with the center axis of the valve seat.

With regard to the valve body, so far nothing more specific has been stated. So the prior art discloses valve bodies with a central plate-shaped part from which further arms extend or which is enclosed by openings.

An optimal structural design solution provides that the valve body is formed as a plate with an outer contour corresponding approximately to the valve seat. This solution has the advantage that no additional arms or other elements unnecessarily increasing the mass of the valve body are necessary to guide the valve body. Rather, such a valve body can be optimally held and guided in the movement space defined above, the cross-sectional area of which corresponds approximately to the cross-sectional area of the valve seat.

In particular in the case of a plate-shaped valve body with an outer contour which corresponds approximately to the valve seat there is the problem that, in the open position of the valve body, the refrigerant entering the movement space via the through-opening of the valve seat must be removed from the movement space.

It is preferably provided for this purpose that at least one outlet space is disposed laterally with respect to the movement space, in particular radially outside the same, which outlet space opens laterally into the movement space with a mouth opening between the valve guard and the valve seat, and leads to an outlet opening.

Such an outlet space creates the possibility when the valve body has been lifted off the valve seat, in particular is in the open position, of allowing the refrigerant flow that is spreading out in the direction of the pressure arm to exit into the high-pressure chamber with as large a cross-section as possible and as unhindered as possible. A particularly large cross-section for the mouth opening of the outlet space into the movement space is available whenever the mouth opening of the outlet space extends as far as the valve seat, preferably therefore between the valve guard and the valve seat.

The outlet opening of the outlet space could be disposed for example opposite the mouth opening. A structurally suitable design solution provides that the outlet opening is disposed in the region of the valve guard.

The outlet opening is preferably disposed in such a way that it merges into a through-opening in the valve guard, and consequently the emerging refrigerant flow also passes through the valve guard via the outlet spaces and the outlet opening.

To have optimal flow cross-sections available, it is preferably provided that a number of outlet spaces are disposed around the movement space.

With regard to the delimitation of the movement space, so far nothing more specific has been stated. So one advantageous solution provides that the movement space is delimited by at least one wall surface lying next to the at least one mouth opening.

Such a wall surface preferably serves as a guiding surface for the valve body, so that the latter is always held in the intended movement space.

It is particularly advantageous in this case if the valve body is guided by a number of guiding surfaces disposed at equal angular intervals around the center axis of the movement space.

In principle it would be possible to support the valve body on the valve guard by a number of points of contact. This has the disadvantage, however, that the valve body must be of a very stable configuration if no damage is to occur to the valve body when it comes against the valve guard, since, when the compressor starts up, the valve body moves at high speed in the direction of the valve guard and is then caught by it.

For this purpose, the valve body is preferably provided with an end face, which can be made to lie flat against the contact surface of the valve guard.

With regard to the sizes of the contact surface and the end face, so far nothing more specific has been stated.

So it is preferably provided that the contact surface extends over a surface area which is greater than half the surface area over which the end face extends.

It is even better if the contact surface extends over a surface area which corresponds approximately to the surface area over which the end face extends.

So far nothing more specific has been stated with regard to the formation of the end face either. So it is preferably provided that the valve body is formed as a plate and the end face extends over a surface area which corresponds to more than half the extent of the valve body transversely in relation to its center axis.

The surface area over which the end face extends is preferably so large that it substantially corresponds to the cross-sectional area of the valve body.

In order to prevent the valve body from remaining attached to the valve guard by adhesion when the pressure in the scroll compressor drops, and not going over quickly enough into the closed position, it is preferably provided that the valve guard is provided with an aperture which extends from a mouth opening lying in the contact surface to a high-pressure side of the valve guard. This achieves the effect that the check valve closes quickly when there is a drop in pressure in the scroll compressor, since, even in the case in which the valve body sticks to the valve guard, the valve body quickly detaches itself from the valve guard on account of the pressure to which it is exposed via the aperture.

The valve body can detach itself particularly quickly from the valve guard if the aperture lies laterally with respect to the center axis of the movement space, and consequently the force acting first on the valve body via the aperture causes tilting of the valve body.

In this case, the aperture is suitably disposed in an angular segment which lies on a side of the center axis of the movement space that is opposite from the center axis of the outlet, so that the aperture lies in one semicircle around the center axis of the movement space, while the center axis of the outlet lies in the other semicircle.

The angular segment in which the aperture lies preferably lies symmetrically in relation to a plane running through the center axis of the outlet and the center axis of the movement space.

The angular segment could comprise an entire semicircle.

It is particularly advantageous, however, if the angular segment within which the at least one aperture lies amounts to approximately 150°, even better approximately 120°.

With regard to the arrangement of the through-openings in the valve guard, so far nothing more specific has been stated. In order not to limit the cross-sectional area available for the refrigerant flow, it is preferably provided that the through-openings in the valve guard lie outside the part of the valve guard that closes off the movement space.

Further features and advantages are the subject of the description which follows and the graphical representation of a number of exemplary embodiments.

DETAILED DESCRIPTION OF THE INVENTION

Figure 1:
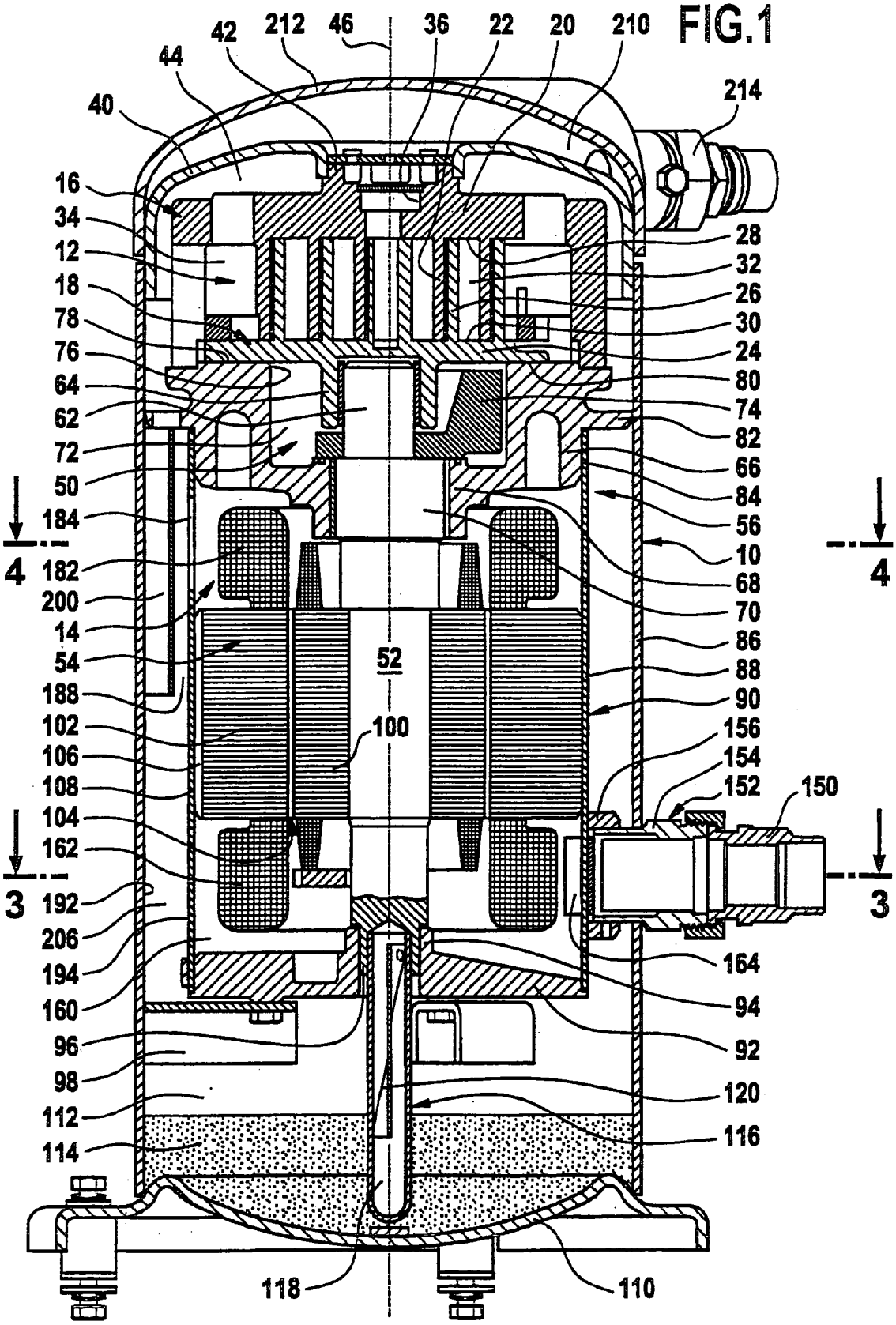
FIG. 1 shows a longitudinal section through an exemplary embodiment of a compressor according to the invention.
Figure 2:
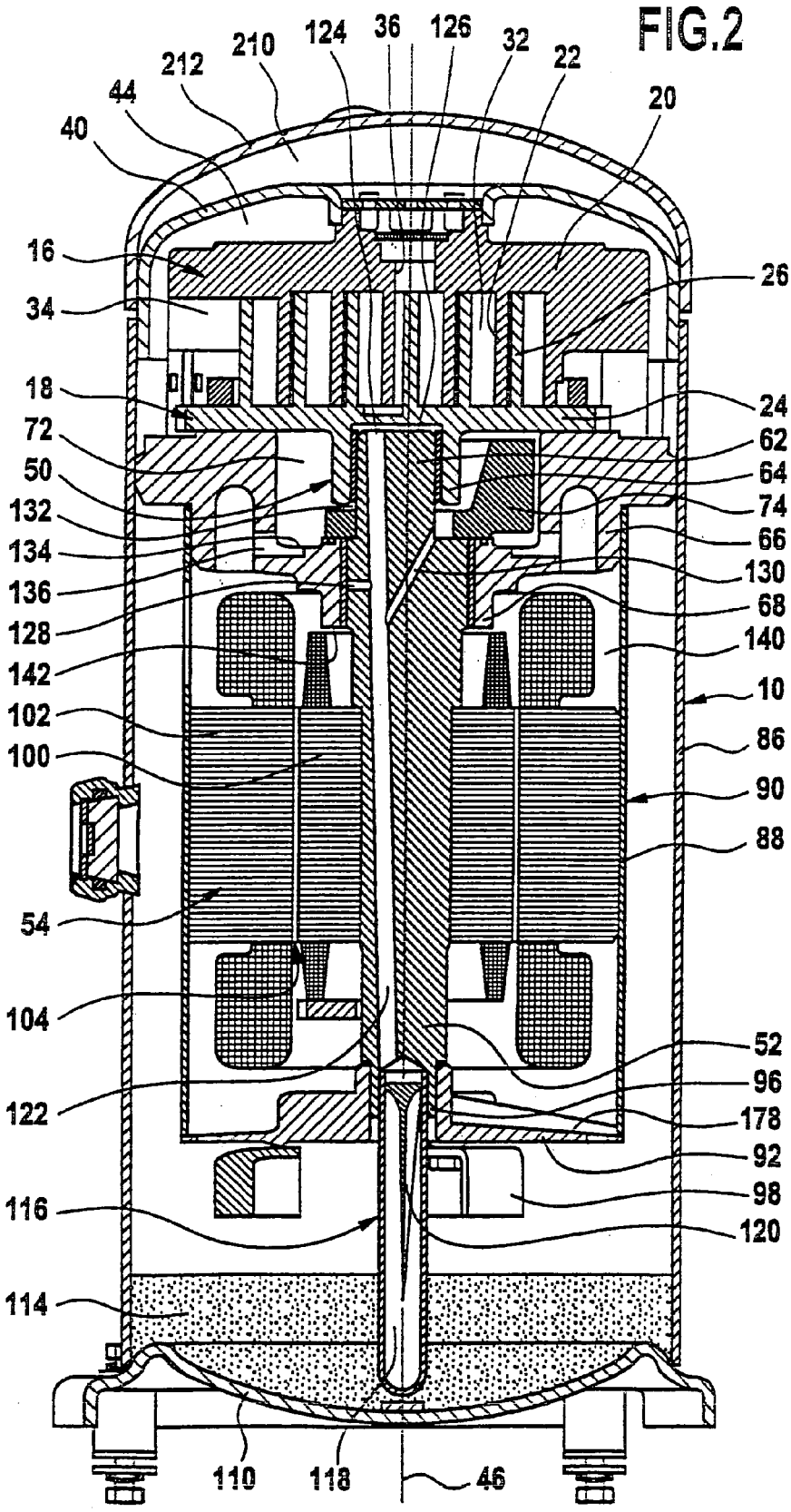
FIG. 2 shows a longitudinal section, turned by an angle of approximately 90°, through the exemplary embodiment of the compressor according to the invention.

An exemplary embodiment of a compressor according to the invention, represented in FIGS. 1 to 5, comprises an outer housing which is designated as a whole by 10 and in which there is disposed a scroll compressor which is designated as a whole by 12 and can be driven by a drive unit which is designated as a whole by 14.

The scroll compressor 12 comprises in this case a first compressor body 16 and a second compressor body 18, the first compressor body 16 having a first scroll rib 22, which rises above a base 20 of the same and is formed in the shape of an involute of a circle, and the second compressor body 18 having a second scroll rib 26, which rises above a base 24 of the same and is formed in the shape of an involute of a circle, the scroll ribs 22, 26 engaging in one another and in each case lying in a sealing manner against the base surfaces 28 and 30, respectively, of in each case the other compressor body 18, 16, so that chambers 32 are formed between the scroll ribs 22, 26 and the base surfaces 28, 30 of the compressor bodies 16, 18, in which chambers there takes place a compression of a refrigerant which flows in at an initial pressure via an intake region 34 surrounding the scroll ribs 22, 26 on the radially outer side and, after the compression in the chambers 32, emerges via an outlet 36 provided in the base 20 of the first compressor body 16, having been compressed to high pressure.

In the first exemplary embodiment described, the first compressor body 16 is held fixed in the outer housing 10, to be precise by means of a separating body 40, which for its part is held on the outer housing 10 inside the same, reaches over the base 20 of the first compressor body 16 at a spacing from it and is connected in a sealed manner to an annular flange 42 of the first compressor body 16, which runs around the outlet 36 and protrudes above the base 20 on a side that is opposite from the scroll rib 26.

Between the base 20 of the first compressor body 16 and the separating body 40 there is consequently formed a cooling chamber 44, which is intended for cooling the base 20 of the first compressor body 16 and is for example the subject of WO 02/052205 A2, to the full content of which reference is made with respect to the cooling of the scroll compressor 12.

By contrast with the first compressor body 16, the second compressor body 18 is movable on a orbital path about a center axis 46 in relation to the first compressor body 16, the scroll ribs 22 and 26 theoretically lying against one another along a line of contact and the line of contact likewise running on the orbital path about the center axis 46 when there is movement of the second compressor body 18.

The drive of the second compressor body 18 on the orbital path about the center axis 46 takes place by the already mentioned drive unit 14, which comprises an eccentric drive 50, a drive shaft 52 driving the eccentric drive 50, a drive motor 54 and a bearing unit 56 for bearingly mounting the drive shaft 52.

To be specific, the eccentric drive 50 is formed by a driver 62, which is disposed eccentrically on the drive shaft 52, and consequently eccentrically in relation to the center axis 46, and engages in a driver receptacle 64, which is fixedly connected to the base 24 of the second compressor body 18, in order in this way to move the second compressor body 18 on the orbital path about the center axis 46.

The bearing unit 56 for its part comprises a first bearing body 66, which represents a main bearing body and with a bearing portion 68 bearingly mounts the drive shaft 52 in a region 70, and which carries the driver 62, the driver 62 preferably being disposed in one piece on the region 70.

Furthermore, the first bearing body 66 encloses a space 72, in which the eccentric drive 50 is disposed and in which a compensating mass 74 fixedly connected to the drive shaft 52 moves.

Moreover, the first bearing body 66 extends laterally with respect to the space 72 in the direction of the base 24 of the second compressor body 18 and has carrying surfaces 78 which run around an opening 76 of the space 72 that is facing the second compressor body 18 and on which the second compressor body 18 rests with a rear side 80 opposite from the second scroll rib 26, and is consequently supported in such a way that the second compressor body 18 is secured against movement away from the first compressor body 16.

The fixing of the first bearing body 66 in the outer housing 10 takes place in this case with mounting arms 82, which extend radially from the first bearing body 66 as far as the outer housing 10 and precisely hold the first bearing body 66 in the latter.

The first bearing body 66 also has on a side opposite from the mounting arms 82 an outer surface 84, on which there is located a housing sleeve 88 of a motor housing 90, which sleeve extends inside and at a spacing from a cylindrical portion 86 of the outer housing 10, is preferably likewise cylindrical and extends as far as a second bearing body 92, which forms a base of the motor housing 90, is disposed at a distance from the first bearing body 66 and forms a bearing portion 94 in which the drive shaft 52 is mounted with an end region 96 coaxially in relation to the center axis 46.

For additional stabilization, the second bearing body 92 is also supported on the outer housing 10 by means of supporting bodies 98.

The entire motor housing 90 consequently runs inside the cylindrical portion 86 of the outer housing 10 and at a spacing from it.

Disposed in the motor housing 90, between the first bearing body 66 and the second bearing body 92, is the drive motor 54, which comprises a rotor 100, mounted on the drive shaft 52, and a stator 102, surrounding the rotor 100, the stator 102 being held by the housing sleeve 88 of the motor housing 90 so as to be fixed in a stable manner in relation to the outer housing 10, so that there is a customary gap 104 between the rotor 100 and the stator 102.

In addition, the stator 102 is provided on its side facing the housing sleeve 88 with cooling channels 106, which run parallel to the center axis 46, for example in the form of outer grooves, in the stator 102 over the entire contact side 108 of the latter, the stator 102 being supported on the housing sleeve 88 via the contact side 108.

Provided between the second bearing body 92 and a base part 110 of the outer housing 10 is a free space 112, which offers the possibility that, with the outer housing 10 rising up above the base part 110 with an approximately vertically running center axis 46, there forms an oil sump 114, in which on the one hand lubricating oil collects under the force of gravity and on the other hand lubricating oil is kept ready to lubricate the compressor according to the invention.

An oil feed pipe 116, extending from the end region 96 of the drive shaft 52 and coaxially in relation to the latter, dips into the oil sump 114 and has in its interior space 118 a feeding blade 120, and consequently acts as an oil pump which pumps oil out of the oil sump 114 into a lubricating oil channel 122, which passes through the drive shaft 52 and allows lubricating oil to leave via a mouth opening 124 on an end face 126 of the driver 62, in order to lubricate the rotary bearing formed between the driver receptacle 64 and the driver 62 for the movement of the second compressor body 18 on the orbital path.

Furthermore, a transverse channel 128 branches off from the lubricating oil channel 122, leads to the rotary bearing formed between the bearing portion 68 of the first bearing body 66 and the region 70 of the drive shaft 52 and lubricates this bearing, and finally a venting channel 130 branches off from the lubricating oil channel 122.

The oil used for lubricating the driver 62 in the driver receptacle 64 leaves the driver receptacle 64 in the region of an opening 132 of the driver receptacle 64 that is facing the region 70, then arrives at a base 134 of the space 70 that is formed by the first bearing body 66 and passes from there via outlet channels 136, which form an oil guide with the base 134, into an upper interior space 140 of the motor housing 90. Furthermore, the oil, which serves for lubricating the region 70 of the drive shaft 52 in the bearing portion 68, leaves the bearing portion 68 on an underside 142 of the latter, and consequently also enters the upper interior space 140 of the motor housing 90.

The supply of refrigerant to be compressed by the scroll compressor 12 to the compressor according to the invention takes place via an intake line 150, which is brought to an intake connection 152, which for its part is held on the outer housing 10, but is brought through the latter to the motor housing 90.

Figure 3:
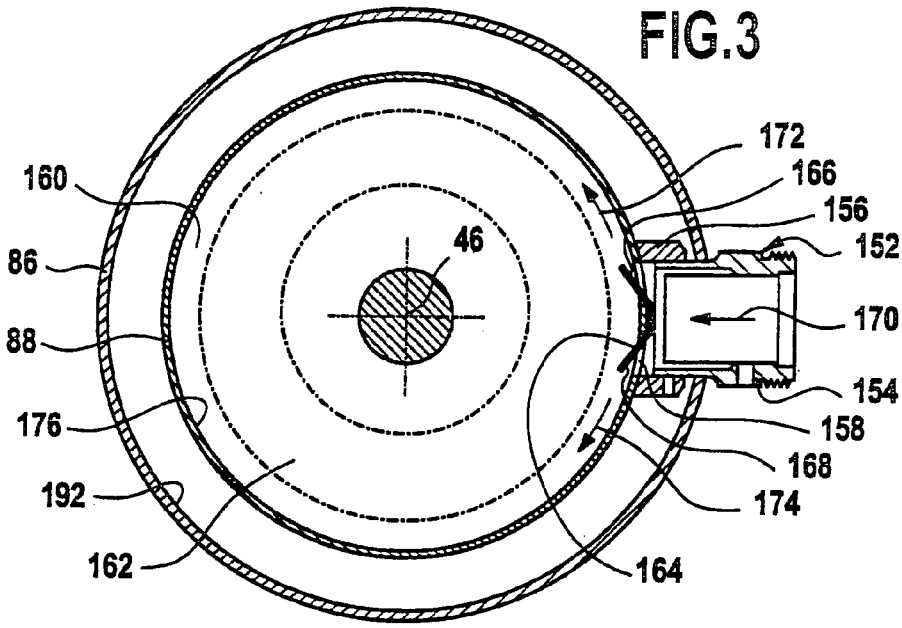
FIG. 3 shows a section along line 3—3 in FIG. 1.

The intake connection 152 preferably has a sleeve 154, which passes through the outer housing 10 of the compressor according to the invention and engages in a receptacle 156 securely connected to the housing sleeve 88 of the motor housing 90, as represented in FIGS. 1 and 3. The receptacle 156 encloses in this case an inlet 158 for the refrigerant that is provided in the housing sleeve 88, so that said refrigerant can directly enter a lower interior space 160 of the motor housing 90 which lies between the stator 102 and the second bearing body 92.

Furthermore, the inlet opening 158 is disposed in the direction of the center axis 46 in such a way that the refrigerant enters the lower interior space 160 at the level of a winding head 162 of the stator 102, which likewise projects into the interior space 160.

Figure 5:
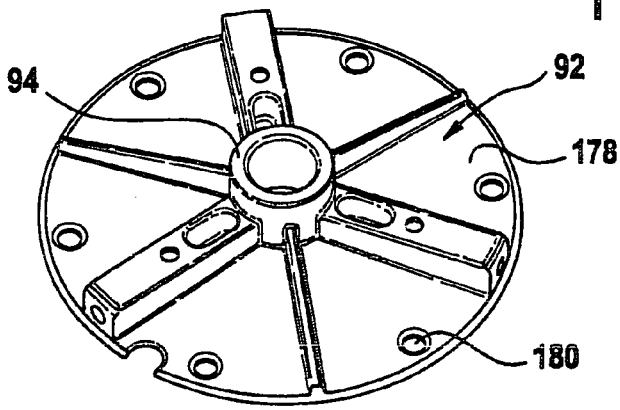
FIG. 5 shows a plan view of a bearing part forming a base of a motor housing.

For optimum distribution of the refrigerant in the lower interior space 160, associated with the inlet 158 is a deflecting unit 164, which has two deflecting surfaces 166 and 168, which deflect the refrigerant flowing in through the sleeve 154 approximately in a radial direction 170 in relation to the center axis 46, in such a way that main directions of flow of the supplied gaseous refrigerant run around the winding head 162 in two opposite azimuthal directions 172 and 174 in relation to the center axis 46, to be precise inside the housing sleeve 88, the inner wall 176 of which thereby provides further guidance for the refrigerant spreading out in the azimuthal directions 172 and 174 and contributes to separation of oil that is entrained by the supplied refrigerant by it being deposited on the inner wall 176 and running down on the latter in the direction of the second bearing body 92, which is represented on its own in FIG. 5. The bearing body 92 also forms a base 178, which substantially closes the housing sleeve 88 but is provided with oil outlet openings 180, from which the oil that is separated can flow into the oil sump 114.

As a result of the closed base 178, the refrigerant entering the lower interior space 160 of the motor housing 90 substantially does not have the possibility of passing into the free space 112 between the second bearing body 92 and the base part 110, but rather remains substantially in the interior space 160 for the purpose of cooling the winding head 162 and then, proceeding from the interior space 160, passes through the cooling channels 106 and the gap 104 between the rotor 100 and the stator 102 into the upper interior space 140, which lies between the first bearing body 66 and the stator 102, in order to cool the winding heads 182 projecting into the upper interior space 140.

Figure 4:
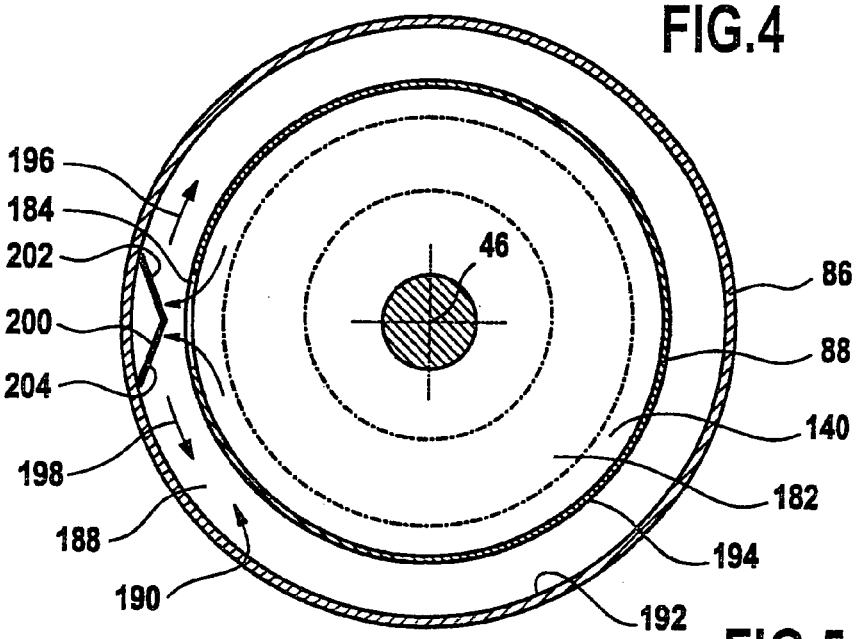
FIG. 4 shows a section along line 4—4 in FIG. 1.

At least one outlet opening 184 is provided at the level of the winding head 82 in the housing sleeve 88, as represented in FIGS. 1 and 4, through which opening the refrigerant leaves the upper interior space 140 of the motor housing 90, to be precise into an intermediate space 188, which exists between the cylindrical portion 88 and the first bearing body 66—apart from the mounting arms 82—and the motor housing 90, and which is part of an oil separator 190. In particular, the intermediate space 188 lies substantially between an inner wall surface 192 of the cylindrical portion 86 of the outer housing 10 and an outer wall surface 194 of the cylindrical housing sleeve 88, the intermediate space 188 preferably extending as a closed annular space around the housing sleeve 88.

To generate a flow of the gaseous refrigerant in opposite azimuthal directions 196, 198 in the intermediate space 188, disposed opposite the outlet opening 184 is a deflecting unit 200, which has deflecting surfaces 202 and 204, which deflect the gaseous refrigerant leaving the outlet opening 184 into the azimuthal directions 196 and 198.

It is, however, also conceivable to provide a number of outlet openings 184, opening into the intermediate space 188, and deflecting units 200 associated with them at angular intervals around the center axis 46.

As a result of the gaseous refrigerant being guided in the azimuthal directions 196 and 198, in particular between the inner wall surface 192 and the outer wall surface 194, an oil separating effect occurs on account of the constantly acting radial acceleration of oil droplets in the gaseous refrigerant, manifested in particular by oil which is entrained by the refrigerant being deposited on the inner wall surface 192 and the outer wall surface 194, it being possible when the compressor is installed with a substantially vertical center axis 46 for the oil to run down between the outer housing 10 and the motor housing 90, preferably along the inner wall surfaces 192 and the outer wall surface 194 in the direction of the oil sump 114, since between the outer housing 10 and the motor housing 90 there is over the entire extent of the motor housing 90 in the direction of the center axis 46 a free intermediate space 206, which proceeds from the intermediate space 188 to merge into the free space 112 and via which the oil can in the end be supplied to the oil sump 114.

The separation of all the oil entrained by the refrigerant on its way through the interior space 160, through the gap 104 and the cooling channels 106 and also the interior space 140, and in particular at least partially oil which leaves on the underside 142 of the bearing portion 68 and oil which has been supplied to the interior space 140 via the outlet channels 136, takes place in the oil separator 190.

The refrigerant that is consequently substantially freed of oil in the oil separator 190 then flows to exit from the intermediate space 188 of the oil separator 190 between the mounting arms 82, and consequently past the first bearing body 66, on the outside of the same, in the direction of the intake region 34 of the scroll compressor 12, and is taken in by the latter and compressed, the compressed refrigerant entering through the outlet 36 and a downstream check valve 208 into a high-pressure chamber 210, which lies between a cover 212 of the outer housing 10 and the separating body 40, and is discharged from this chamber through a pressure connection 214.

The check valve 208 has a pre-chamber 216, disposed following the outlet 36, and following this pre-chamber a valve seat 218, on which a valve body 220 can be placed.

Figure 8:
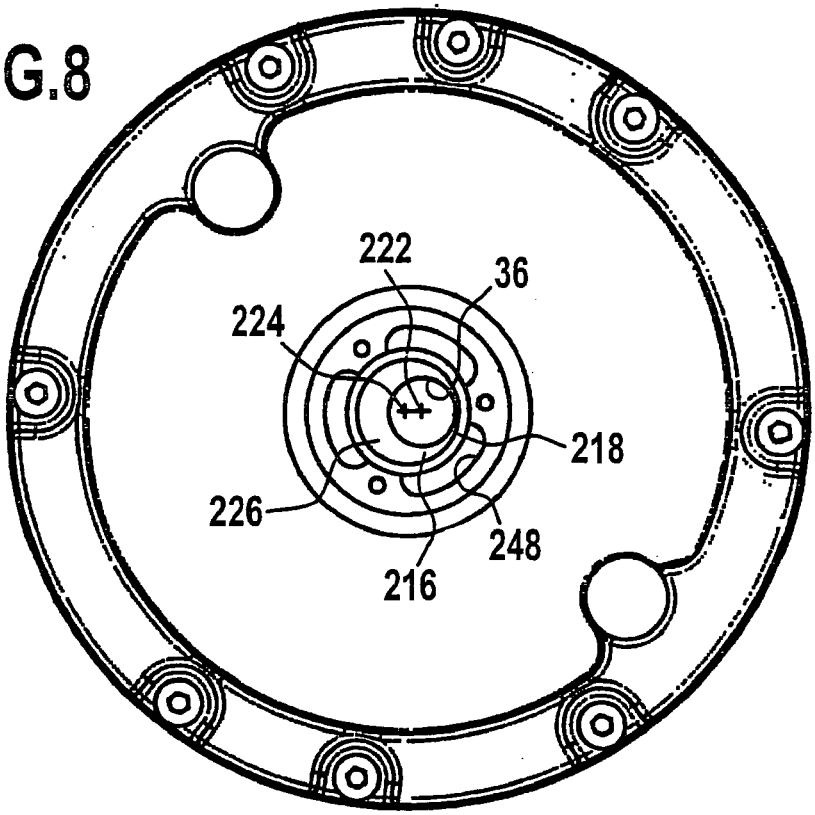
FIG. 8 shows a section along line 8—8 in FIG. 7.
Figure 9:
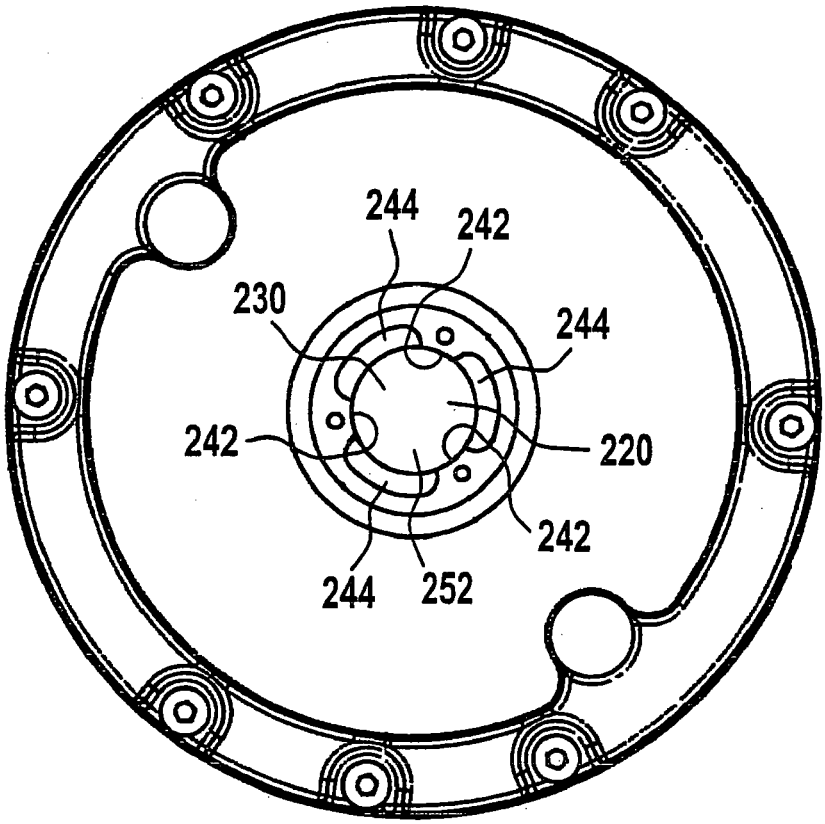
FIG. 9 shows a section along line 9—9 in FIG. 7.

As can be gathered in particular from FIG. 8, a center axis 222 of the outlet 36 is disposed laterally offset with respect to a center axis 224 of the pre-chamber 216, so that overall the outlet 36 opens out asymmetrically into the pre-chamber 216.

For this purpose, the pre-chamber 216 is provided with a cross-sectional area which amounts to a multiple of the cross-sectional area of the outlet 36, so that the outlet 36 opens with the full cross-sectional area into a base 226 of the pre-chamber 216.

The pre-chamber 216 then extends subsequently with its enlarged cross-sectional area in comparison with the outlet 36 as far as the valve seat 218 in the direction of the center axis 224, so that, with the valve body 220 lifted off, in the region of the valve seat 218 a through-opening 228 with a cross-sectional area corresponding to the cross-sectional area of the pre-chamber 216 is available for the flow to pass through the valve seat 218.

The valve body 220 is formed as a plate-shaped body extending continuously, that is to say without openings, as far as an outer contour 238, the outer contour 238 having a geometrically simple shape, for example a circle, although the shape may also be elliptical or rectangular, possibly formed with rounded corners.

On a side opposite from the pre-chamber 216, a movement space 230 for the valve body 220 rises up above the valve seat 218 and has a center axis 232 which coincides with the center axis 224. The movement space 230 extends along the center axis 232 above the valve seat 218 as far as a valve guard which is designated as a whole by 240 and delimits the movement space 230 on a side opposite from the valve seat 218.

The cross-sectional area of the movement space 230 in this case corresponds approximately to the cross-sectional area in the region of the valve seat 218, so that the valve body 220 can move freely in the movement space 230 between a closed position (FIG. 7), in which the valve body 220 rests on the valve seat 218, in an open position (FIG. 10), in which the valve body 220 lies against the valve guard 240.

For guiding the valve body 220 which is movable in the movement space 230, the movement space 230 has adjoining the valve seat 218 guiding surfaces 242, which run parallel to the center axis 232, in the simplest case are formed by wall surfaces delimiting the movement space 230 and, for example, are disposed at equal angular spacings from one another, in order to guide the valve body 220 in the direction of the center axis 232 of the movement space 230 on its circumferential side 238, so that it is ensured in particular that the valve body 220 comes to lie on the valve seat 218 with the necessary precision during the transition from the open position into the closed position.

Figure 10:
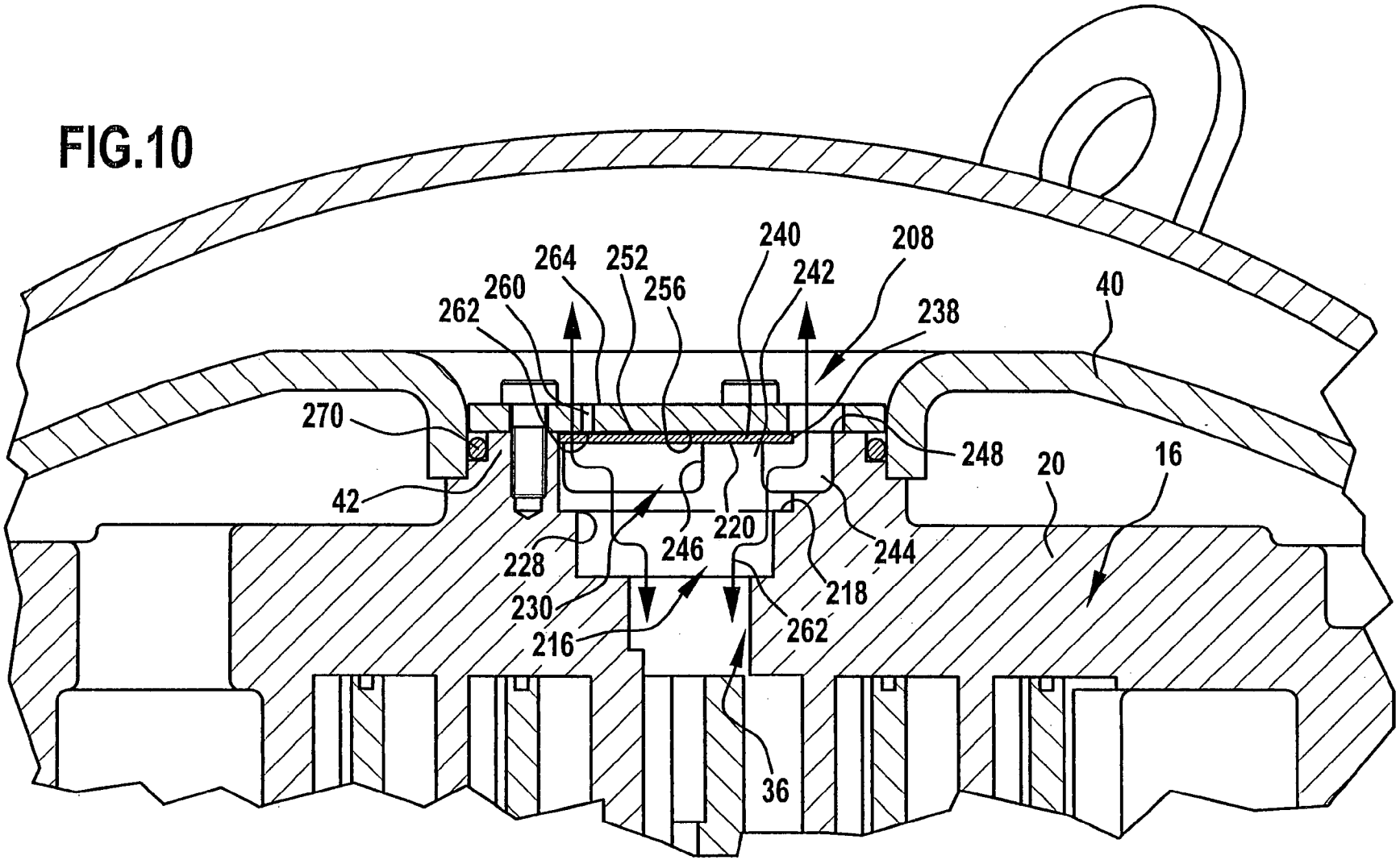
FIG. 10 shows a section corresponding to FIG. 7 with the valve body in the open position.
Figure 11:
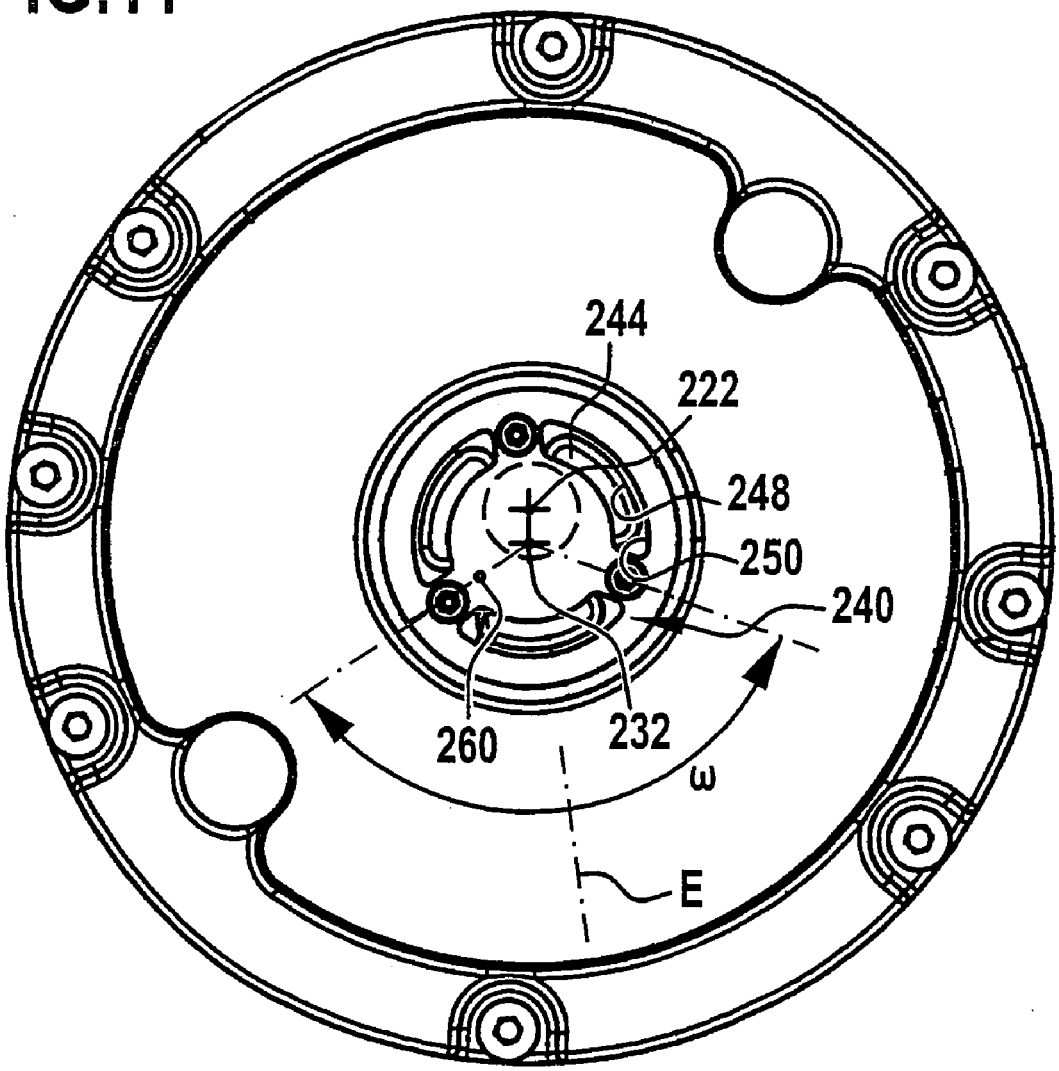
FIG. 11 shows a section along line 11—11 in FIG. 7.

To make it possible when the valve body 220 is in the open position, as represented in FIG. 10, for gaseous refrigerant that has entered the movement space 230 through the pre-chamber 216 and the valve seat 218 to flow out from the movement space 230, provided laterally with respect to the movement space 230 are outlet spaces 244, which open laterally via mouth openings 246 into the movement space 230, the mouth openings 246 preferably extending in the direction of the center axis 232 from the valve guard 240 as far as the valve seat 218 and extending in the circumferential direction about the center axis 232 in each case as far as the guiding surfaces 242.

Furthermore, the outlet spaces 244 lead to outlet openings 248 facing the valve guard 240, which for their part merge into through-openings 250 provided in the valve guard 240, the through-openings 250 in the valve guard 240 having a cross-sectional area which is greater than the cross-sectional area of the outlet openings 248 of the outlet spaces 244. Consequently, gaseous refrigerant entering the movement space 230 through the valve seat 218 in the open position of the valve body 220 has the possibility of leaving the movement space 230 via the mouth openings 246, flowing through the outlet spaces 244 and entering into the high-pressure chamber 210 from the outlet spaces 244 via their outlet openings 248 and the through-opening 250 in the valve guard 240.

The flow cross-sections of the outlet spaces 244 and of the outlet openings 248 as well as of the through-openings 250 in the valve guard are in this case chosen such that the gaseous refrigerant flowing through the movement space 230 and the outlet chambers 244 can flow around the valve body 220 in the open position and thereby also contributes to moving the valve body 220 in the direction of the open position, in which the valve body 220 lies for example against the valve guard 240, when the check valve 208 is opened.

The valve body 220 has for its part, facing the valve guard 240, an upper end face 252, which preferably extends over the entire extent of the valve body 220 transversely in relation to the center axis 232 as far as the outer contour 238 and, in the case of the open position of the valve body 220—as represented in FIG. 10—lies against a contact surface 254 of the valve guard 240, the contact surface 254 extending over a surface area which substantially corresponds to the surface area over which the end face 252 extends, so that the end face 252 can be made to lie fully flat against the contact surface 254 of the valve guard 244, in particular to avoid damage to the valve body 220 when there is a quick transition from the closed position into the open position.

Figure 6:
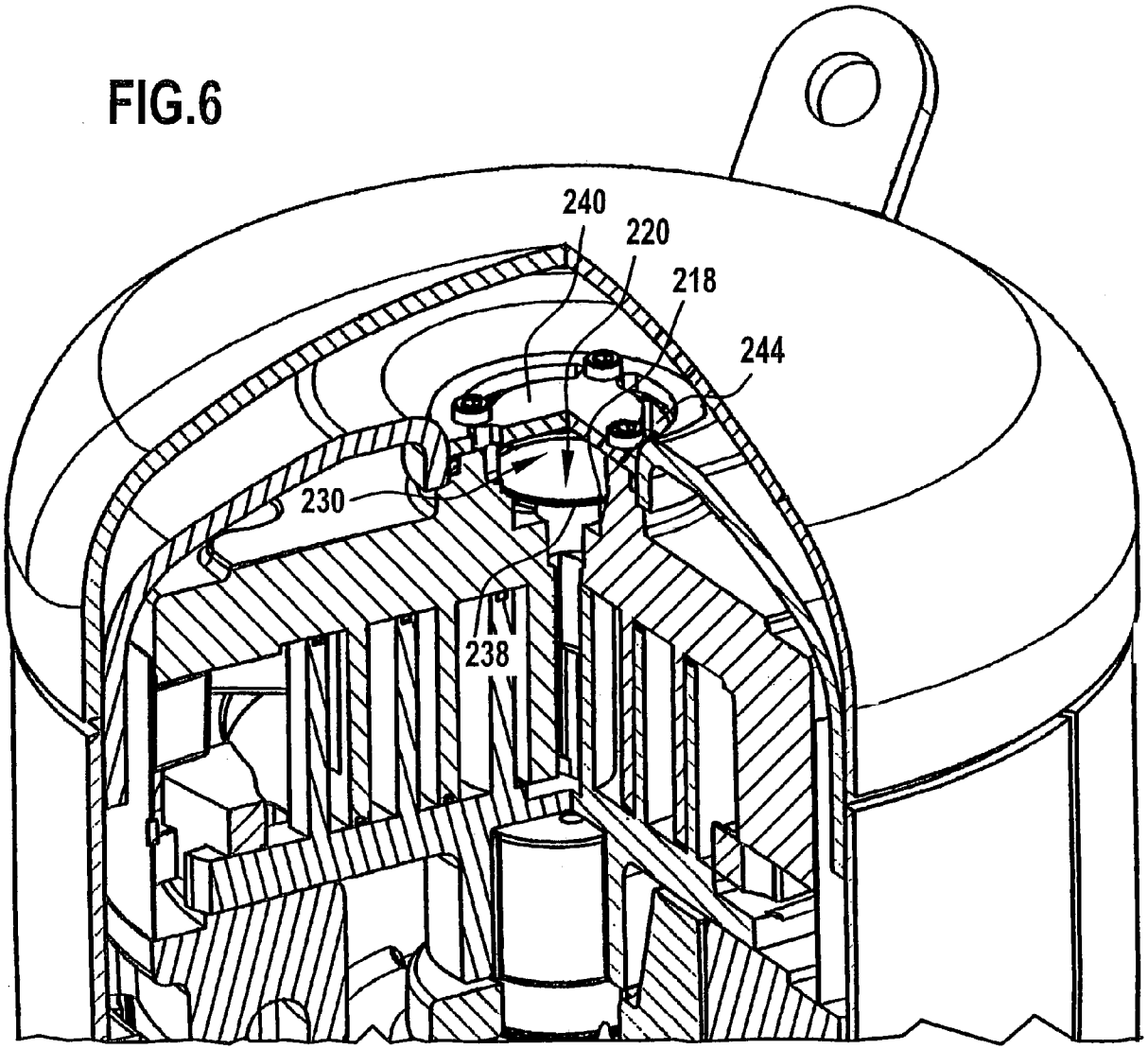
FIG. 6 shows a perspective representation of a section in the region of a check valve.
Figure 7:
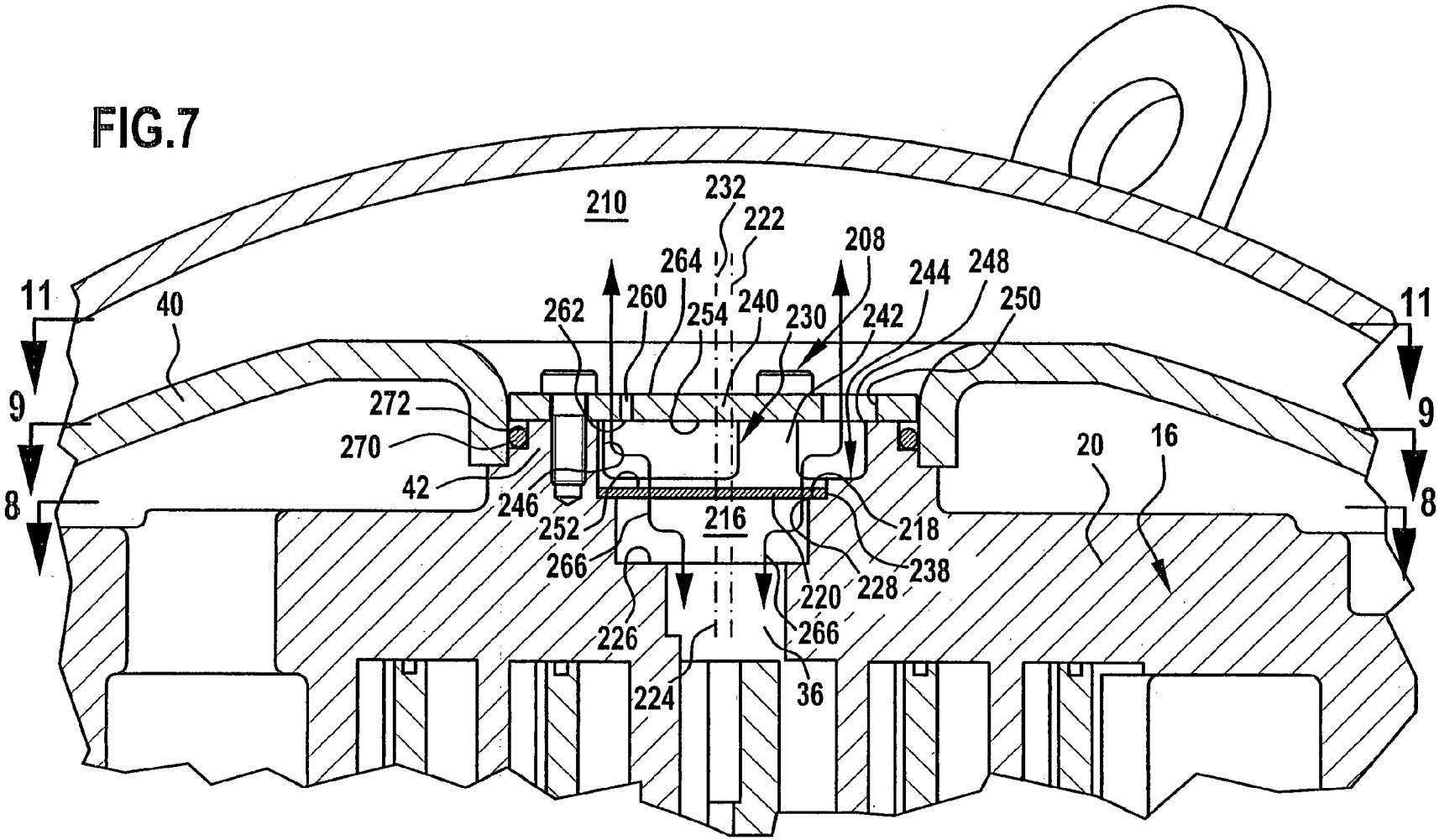
FIG. 7 shows an enlarged sectional representation similar to FIG. 1 in the region of the check valve.

To be able to move the valve body 220 quickly from the open position into the closed position, and in particular to be able quickly to eliminate any kind of adhesion of the valve body 220 to the valve guard 240 by engagement of the end face 252 against the contact surface 254, the valve guard 240 is provided with an aperture 260, which extends from a mouth opening 262 lying in the contact surface 254 of the valve guard 240 as far as an upper side 264 of the valve guard 240 that is facing the high-pressure chamber 210, in order to use the pressure that is present in the high-pressure chamber 210 when there is a drop in the pressure in the movement space 230 for making a force act on the partial region of the end face 252 that is facing the aperture 260 and then, when the valve body 220 detaches itself with the end face 252 from the contact surface 254, finally use the pressure in the high-pressure chamber 210 for making a force act on the entire end face 252 in order to move the valve body 220 into the movement space 230 so far from the open position in the direction of the closed position that the gaseous refrigerant flow 262 flowing back in the direction of the outlet 36 via the outlet spaces 244 additionally takes the valve body 220 with it and moves it in an accelerated manner in the direction of the closed position, represented in FIGS. 6 and 7, in order to achieve quick closing of the check valve 208.

The aperture 260 is in this case preferably not disposed symmetrically in relation to the center axis 232, but offset laterally with respect to it, to be precise on a side of the center axis 232 that is opposite from the center axis 222 of the outlet 36, and also within an angular range W about the center axis 232 which extends symmetrically in relation to a plane E which runs through the center axis 232 of the movement space 230 and the center axis 222 of the outlet 36.

As a result of this arrangement of the aperture 260, when the end face 252 detaches itself from the contact surface 254, the valve body 220 is subjected to a force which is unsymmetrical in relation to the center axis 232, which leads to the effect that the valve body 220 lifts off more quickly from the contact surface 254 with the partial region of the end face 252 lying close to the aperture 260 than with the partial regions lying over the outlet 36, and consequently the valve body 220 performs a slight tilting movement, which is conducive overall to the detachment of the end face 252 from the contact surface 254 and also moves the valve body 220 more quickly into the refrigerant flow 262, which runs through the outlet spaces 244 and the movement space 230 in the direction of the pre-chamber 216, so that this refrigerant flow 262 moves the valve body 220 in an accelerated manner in the direction of the valve seat 218, and consequently into the closed position.

In addition, the moving of the valve body 220 from the open position into the closed position can also be accelerated by the outlet 36 opening asymmetrically into the base 226 of the pre-chamber 216, and consequently forming overall, both in the pre-chamber 216 and in the movement space 230, a refrigerant flow 266 from the high-pressure chamber 210 in the direction of the outlet 36 that is asymmetrical in relation to the center axis 232, which additionally contributes to moving the valve body 220 in an accelerated manner into the closed position after leaving the open position.

According to the invention, the check valve 208 is realized by the outlet 36, and substantially the pre-chamber 216, still being located within the base 20 of the compressor body 16, while the valve seat 216, the movement space 230 and the outlet spaces 244 are machined into the annular flange 42 formed in one piece on the base 20, and finally the valve guard 240 rests on the annular flange 42 in the form of a cover.

In the case of the solution according to the invention, the valve guard 240 not only has the described function but also extends radially in relation to the center axis 232 so far in the direction of the separating body 40 engaging on the annular flange 42 that the valve guard 240 reaches over a seal 270 that is effective between the annular flange 42 and the separating body 40, lies in a groove 272 enclosing the annular flange 42 and brings about a pressure-resistant connection between the annular flange 42 and the separating body 40.

The invention claimed is:

1. Compressor for refrigerant, comprising:

an outer housing, a scroll compressor which is disposed in the outer housing and has a first compressor body, which is fixedly disposed in the outer housing, and a second compressor body, which is movable in relation to the first compressor body, each of these bodies having a base and respective first and second scroll ribs, which rise above the respective base and engage in one another in such a way that, for the compression of the refrigerant, the second compressor body is movable on an orbital path about a center axis with respect to the first compressor body, thereby forming chambers, an outlet in the base of the first compressor body, leading to a high-pressure chamber in the outer housing, a check valve disposed between the outlet and the high-pressure chamber, with a valve body which is freely movable in a movement space extending between a valve seat and a valve guard, between a closed position, determined by the valve seat, and an open position, determined by the valve guard, and comprising a pre-chamber having a greater cross-sectional area than the outlet, said pre-chamber being disposed between the valve seat and the outlet.

2. Compressor according to claim 1, wherein the cross-sectional area of the pre-chamber corresponds at least to a cross-sectional area of the through-opening.

3. Compressor according to claim 1, wherein a center axis of the pre-chamber is disposed in such a way that it is offset transversely in relation to the center axis of the outlet.

4. Compressor according to claim 3, wherein the center axis of the pre-chamber substantially coincides with the center axis of the valve seat.

5. Compressor according to claim 1, wherein the movement space extends in the direction of its center axis from the valve seat to the valve guard with a cross-sectional area which corresponds approximately to the valve seat.

6. Compressor according to claim 5, wherein the center axis of the movement space substantially coincides with the center axis of the valve seat.

7. Compressor according to claim 5, wherein the valve body is formed as a plate with an outer contour corresponding approximately to the valve seat.

8. Compressor according to claim 1, wherein is disposed laterally with respect to the movement space, which outlet space opens laterally into the movement space with a mouth opening between the valve guard and the valve seat, and leads to an outlet opening.

9. Compressor according to claim 8, wherein the mouth opening of the outlet space extends as far as the valve seat.

10. Compressor according to claim 8, wherein the outlet opening is disposed in the region of the valve guard.

11. Compressor according to claim 10, wherein the outlet opening merges into a through-opening in the valve guard.

12. Compressor according to claim 11, wherein the through-openings in the valve guard lie outside a part of the valve guard that closes off the movement space.

13. Compressor according to claim 8, wherein a number of outlet spaces are disposed around the movement space.

14. Compressor according to claim 8, wherein the movement space is delimited by at least one wall surface lying next to the at least one mouth opening.

15. Compressor according to claim 14, wherein the at least one wall surface forms a guiding surface for the valve body.

16. Compressor according to claim 15, wherein the valve body is guided by a number of guiding surfaces disposed at equal angular intervals around the center axis of the movement space.

17. Compressor according to claim 1, wherein the valve guard has a contact surface for the valve body.

18. Compressor according to claim 17, wherein the valve body has an end face, which can be made to lie flat against the contact surface of the valve guard.

19. Compressor according to claim 18, wherein the contact surface extends over a surface area which is greater than half the surface area over which the end face extends.

20. Compressor according to claim 19, wherein the contact surface extends over a surface area which corresponds approximately to the surface area over which the end face extends.

21. Compressor according to claim 18, wherein the valve body is formed as a plate and the end face extends over a surface area which corresponds to more than half the extent of the valve body transversely in relation to its center axis.

22. Compressor according to claim 21, wherein the surface area over which the end face extends substantially corresponds to the cross-sectional area of the valve body.

23. Compressor for refrigerant, comprising:

an outer housing.

a scroll compressor which is disposed in the outer housing and has a first compressor body, which is fixedly disposed in the outer housing, and a second compressor body, which is movable in relation to the first compressor body, each of these bodies having a base and respective first and second scroll ribs, which rise above the respective base and engage in one another in such a way that, for the compression of the refrigerant, the second compressor body is movable on an orbital path about a center axis with respect to the first compressor body, thereby forming chambers, an outlet in the base of the first compressor body, leading to a high-pressure chamber in the outer housing.

a check valve disposed between the outlet and the high-pressure chamber, with a valve body which is freely movable in a movement space extending between a valve seat and a valve guard, between a closed position, determined by the valve seat, and an open position, determined by a contact surface for the valve body on the valve guard, the valve guard being provided with at least one aperture which extends from a mouth opening lying in the contact surface to a high-pressure side of the valve guard, the at least one aperture being offset laterally with respect to the center axis of the movement space.

24. Compressor according to claim 23, wherein the at least one aperture is disposed in an angular segment which lies on a side of the center axis of the movement space that is opposite from the center axis of the outlet.

25. Compressor according to claim 24, wherein the angular segment lies symmetrically in relation to a plane running through the center axis of the outlet and the center axis of the movement space.

26. Compressor according to claim 25, wherein the angular segment amounts to approximately 150°.

* * * * *

UNITED STATES PATENT AND TRADEMARK OFFICE

CERTIFICATE OF CORRECTION

PATENT NO. : 7,112,046 B2
APPLICATION NO. : 11/104273
DATED : September 26, 2006
INVENTOR(S) : Kammhoff et al.

It is certified that error appears in the above-identified patent and that said Letters Patent is hereby corrected as shown below:

Column 12, line 7 - After the word "wherein", insert the words -- at least one outlet space --.

Signed and Sealed this

Fifteenth Day of May, 2007

JON W. DUDAS
*Director of the United States Patent and Trademark Office*